US006472816B1

(12) United States Patent
Ikeda et al.

(10) Patent No.: US 6,472,816 B1
(45) Date of Patent: Oct. 29, 2002

(54) ELECTROLUMINESCENT MODULE WITH FLEXIBLE, INSULATING RESIN LAYER AND CONNECTING ELECTRODES IN FACING OPPOSITE SIDES

(75) Inventors: Hidetsugu Ikeda; Yoshikatsu Dobuchi, both of Tokyo (JP)

(73) Assignee: Seiko Precision, Inc, Tokyo (JP)

( * ) Notice: Subject to any disclaimer, the term of this patent is extended or adjusted under 35 U.S.C. 154(b) by 0 days.

(21) Appl. No.: 09/267,811

(22) Filed: Mar. 12, 1999

(30) Foreign Application Priority Data

Mar. 13, 1998 (JP) ..... 10-061812

(51) Int. Cl.[7] ..... H01J 1/62
(52) U.S. Cl. ..... 313/498; 313/509
(58) Field of Search ..... 313/504, 506, 313/498, 512, 509

(56) References Cited

U.S. PATENT DOCUMENTS 5,844,362 A 12/1998 Tanabe et al.

FOREIGN PATENT DOCUMENTS

EP 0984688 E 3/2000
JP 58-52635 11/1983
JP 1-194291 8/1989
JP 2-197 1/1990

OTHER PUBLICATIONS

JP 9–35873 English Abstract.
JP 62–111198 English Abstract.
JP 58–52635 English Abstract.
JP 2–197 English Abstract.
JP 1–194291 English Abstract.

*Primary Examiner*—Vip Patel
*Assistant Examiner*—Joseph Williams
(74) *Attorney, Agent, or Firm*—Schulte, Roth & Zabel; Donna L. Angotti, Esq.; Joel E. Lutzker, Esq.

(57) ABSTRACT

The quality of an electroluminescent module is improved, and the production costs for it are reduced. In an electroluminescent module comprising a circuit board 1 and an electroluminescent element 2 as bonded to each other, the bonding electrode parts 3*a*, 3*b* via which the two 1 and 2 are bonded, are positioned in the facing opposite sides of the electroluminescent element 2, and the two are electrically connected and physically bonded via those parts 3*a*, 3*b* to thereby reduce the bonding space. Flexible, insulating resin layers 10*a*, 10*b* are provided between the transparent electrode layer 4*a* and the conductive layer 11 at the connecting electrode part 3*a* as electrically connected with the transparent electrode layer 4*a* and between the transparent electrode layer 4*a* and the back electrode layer 7 at the connecting electrode part 3*b* as electrically connected with the back electrode layer 7, respectively.

9 Claims, 3 Drawing Sheets

ELECTROLUMINESCENT MODULE WITH FLEXIBLE, INSULATING RESIN LAYER AND CONNECTING ELECTRODES IN FACING OPPOSITE SIDES

BACKGROUND OF THE INVENTION

1. Field of the Invention

The present invention relates to an electroluminescent module comprising an electroluminescent element as combined with an circuit board, etc.

2. Description of the Related Art

An electroluminescent element comprises a transparent electrode layer of ITO as formed on the back surface of a transparent electrode film that is positioned in the front, in which a light-emitting layer, a dielectric layer and a back electrode layer are formed in that order on the back surface of the transparent electrode layer. With that constitution, an electroluminescent element is electrically connected with a circuit board, on which is mounted the electroluminescent element or a driving circuit for a portable electronic appliance as connected with the electroluminescent element, by connecting each electrode part of the transparent electrode layer and the back electrode layer of the electroluminescent element with the circuit pattern or the flexible print cable (FPC) as formed on the circuit board.

Integrating an electroluminescent element with a circuit board or the like in the manner mentioned above gives an electroluminescent module, which is built in various electronic appliances. For example, an electroluminescent element is much used as the backlight for the switch key and the display part of portable telephones, in which an electroluminescent element is fitted to and electrically connected with a circuit board provided with a driving circuit in such a manner that the electrode parts of the electroluminescent element are connected with the connecting pattern of the circuit board.

FIG. 3A and FIG. 3B show interconnection structures of the electrode parts of a conventional electroluminescent module. In FIG. 3A, the electrode part 43*a* is in the side of the transparent electrode layer. In FIG. 3B, the electrode part 43b is in the side of the back electrode layer. In those, the front of the circuit board 41 (upper surface in FIG. 3A and FIG. 3B) is provided with a connecting pattern (not shown), and an electroluminescent element is fitted thereto via a conductive adhesive 42*a*. On the back surface of the transparent electrode film 44 of the electroluminescent element, formed is a transparent electrode layer 45. In the part that is to be the electrode part 43*a*, a conductive layer 46 is formed on the back surface of the transparent electrode layer 45. While pressing a hot iron against the electrode part 43*a*, the connecting pattern is electrically connected with the transparent electrode layer 45 via the conductive adhesive 42*a*.

FIG. 3B shows the electrode part 43*b* in the side of the back electrode layer. In this, an electroluminescent element is fitted under pressure to the connecting pattern as formed on the circuit board 41 in a position different from that of the electrode part 43*a* in the side of the transparent electrode layer, via a conductive adhesive 42*b*. The electroluminescent element comprises a light-emitting layer 47, a dielectric layer 48 and a back electrode layer 49 as formed on the back surface of the transparent electrode layer 45 formed on the back surface of the transparent electrode film 44. In the region to be the connecting electrode part, the light-emitting layer 47 is not formed. In that region, formed is a dielectric layer 48 to fill it, by which the contact of the transparent electrode layer 45 with the back electrode layer 49 is blocked. Under thermal pressure, the connecting pattern is electrically connected with the back electrode layer 49 via the conductive adhesive 42*b* therebetween.

As mentioned hereinabove, when each electrode part is connected with the connecting pattern under thermal pressure, the part against which a hot iron for thermal pressure is pressed is heated at high temperature of 160 C or higher. Therefore, that part thus heated under pressure shall receive residual peeling stress and external peeling force, whereby the electrode part in the side of the transparent electrode layer will be cracked or the transparent electrode layer and the electrode part will be delaminated at the boundary therebetween. Such cracking and delamination will often cause electrical interconnection failure. Also in the electrode part in the side of the back electrode layer, the transparent electrode layer and the back electrode layer will be delaminated at the boundary therebetween owing to the residual peeling stress and the external peeling force.

In the related art, the position at which the electroluminescent element is fitted to the circuit board differs from that at which each electrode part is connected with the circuit pattern, which, however, requires different steps for the fitting and the connection in different positions, thereby causing the increase in the production costs. In that, in addition, since the electrode interconnection area differs from the electroluminescent element-fitting area, a large space is needed for those areas, and the electroluminescent element fitting to the circuit board could not be well balanced with the electrode interconnection on the board. This brings about still another problem in that the fitting of the electroluminescent element to the circuit board is often unstable.

SUMMARY OF THE INVENTION

To solve the problems noted above, the electroluminescent module of the invention comprises an electroluminescent element as electrically connected with a circuit board on which is mounted the electroluminescent element or a driving circuit for a portable electronic appliance as connected with the electroluminescent element, and is characterized in that the connecting electrode part in the side of the transparent electrode layer and the connecting electrode part in the side of the back electrode layer are provided in the facing opposite sides of the electroluminescent element, and that the electroluminescent element is electrically connected with the circuit board via the connecting electrode parts by bonding it to the circuit board at those parts. With that constitution, the electroluminescent module of the invention saves any superfluous space of the circuit board to which the electroluminescent element is bonded.

In the electroluminescent module of the invention, a flexible, insulating resin layer is provided in two separate sites both adjacent to the transparent electrode layer in such a manner that the connecting electrode part to be electrically connected with the transparent electrode layer is provided on one insulating resin layer while the connecting electrode part to be electrically connected with the back electrode layer is provided on the other insulating resin layer. In this, these insulating resin layers are to absorb the residual peeling stress and the external peeling force applied to the boundary between the connecting pattern of the circuit board and each connecting electrode of the electroluminescent element so as to prevent the delamination at their boundary, thereby improving the quality of the electroluminescent module.

BRIEF DESCRIPTION OF THE DRAWINGS

FIG. 3A is a cross-sectional view of the connecting electrode part in the side of the transparent electrode layer, and FIG. 3B is a cross-sectional view of the connecting electrode part in the side of the back electrode layer.

DETAILED DESCRIPTION OF THE INVENTION

The electroluminescent module of the invention comprises an electroluminescent element having a light-emitting layer, a dielectric layer and a back electrode layer as laminated in that order on a transparent electrode layer formed on a transparent electrode film, and a circuit board on which is mounted the electroluminescent element or a driving circuit for a portable electronic appliance as connected with the electroluminescent element and which is so disposed that at least a part of it overlaps with the electroluminescent element. In the electroluminescent module with that constitution, the connecting electrode part formed in the transparent electrode layer and the connecting electrode part formed in the back electrode layer are both electrically connected with a pair of connecting patterns for the electroluminescent element as provided on the circuit board, and the both connecting electrode parts are provided in the facing opposite sides of the electroluminescent element.

On the transparent electrode layer of the electroluminescent element, formed is a flexible, insulating resin layer at predetermined two separate sites, and the connecting electrode part to be electrically connected with the transparent electrode layer is formed on one insulating resin layer while the connecting electrode part to be electrically connected with the back electrode layer is formed on the other insulating resin layer. The two connecting electrodes are separately bonded under thermal pressure to the pair of connecting patterns on the circuit board, while being electrically connected with them.

DESCRIPTION OF THE PREFERRED EMBODIMENTS

Figure 1:
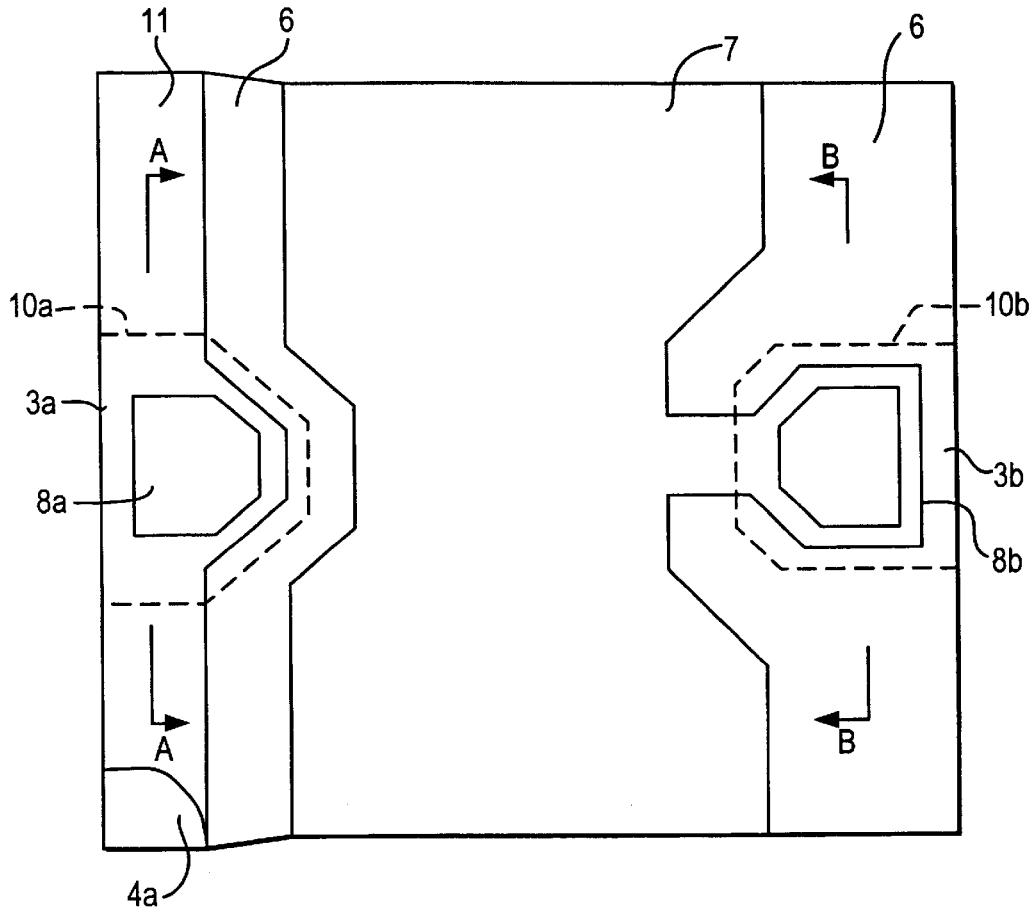
FIG. 1 is a schematic back view showing the essential part of one embodiment of the electroluminescent module of the invention, in which the circuit board is not shown.

FIG. 1 is a schematic back view showing the essential part of one embodiment of the electroluminescent module of the invention, in which the circuit board is not shown. The electroluminescent module of this embodiment comprises a circuit board 1 and an electroluminescent element 2 formed thereon, in which the electroluminescent element 2 or a driving circuit for a portable electronic appliance as connected with the electroluminescent element 2 is mounted on the circuit board 1 (see FIG. 2A and FIG. 2B).

Figure 2A:
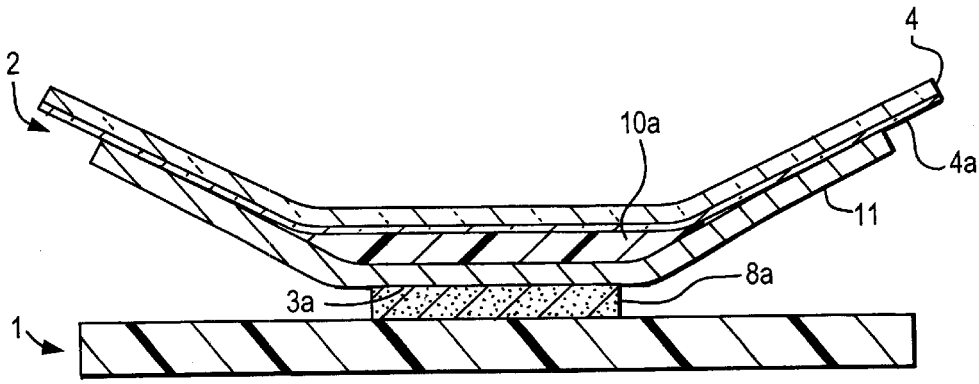
FIG. 2A shows the constitution of the connecting electrode part in the embodiment of FIG. 1, and this is an enlarged cross-sectional view of FIG. 1 as cut along the A—A line.
Figure 2B:
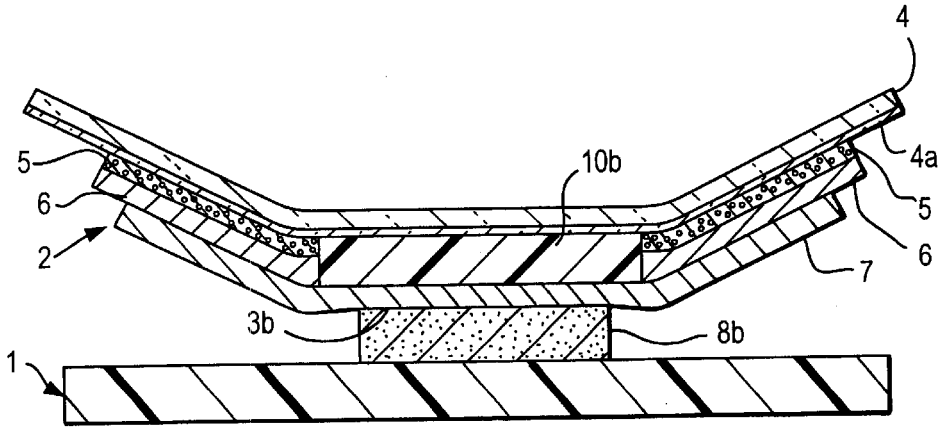
FIG. 2B also shows the constitution of the connecting electrode part in the embodiment of FIG. 1, and this is an enlarged cross-sectional view of FIG. 1 as cut along the B—B line.
Figure 3A:
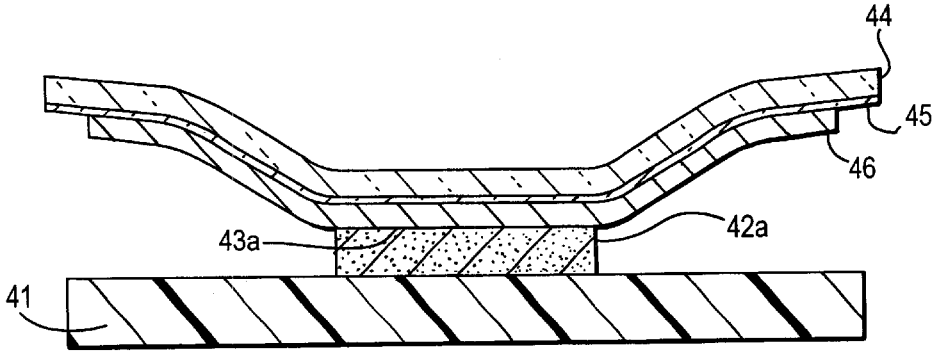
FIG. 3A and FIG. 3B show the constitution of the connecting electrode parts in a conventional electroluminescent module.
Figure 3B:
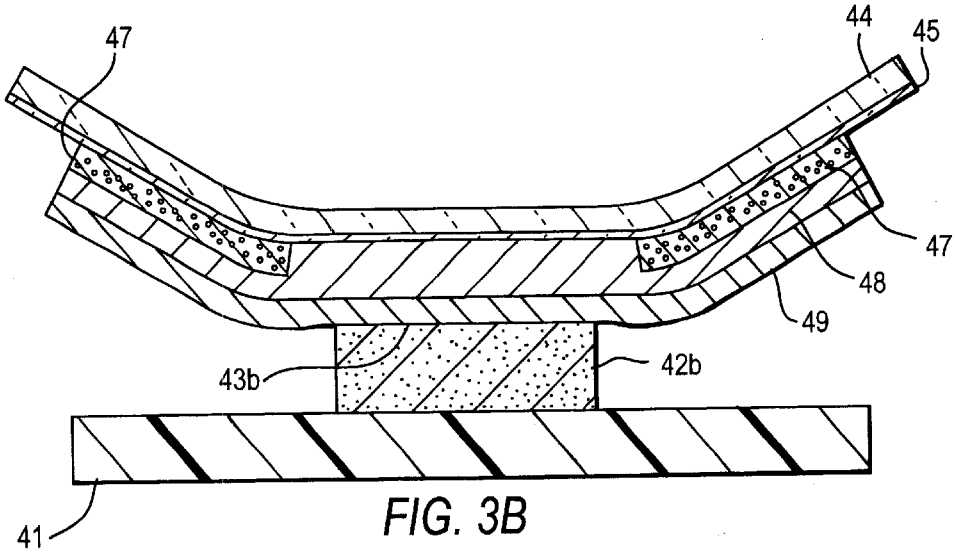

In the facing opposite sides of the electroluminescent element 2, provided are connecting electrode parts 3*a*, 3*b*, via which the electroluminescent element 2 is bonded to and electrically connected with the circuit board 1. FIG. 2A and FIG. 2B are enlarged views showing the connecting electrode parts 3*a*, 3*b*.

In the front side of the electroluminescent element 2, formed is a transparent electrode layer 4*a* on the back surface of the transparent electrode film 4, and a light-emitting layer, 5, a dielectric layer 6 and a back electrode layer 7 are laminated in that order on the back surface of the transparent electrode layer 4*a*. The transparent electrode film 4 is of a sheet of polyethylene terephthalate (PET), and the transparent electrode layer 4*a* is formed through vapor deposition of ITO on the back surface of the transparent electrode film 4. The light-emitting layer 5 is formed within a predetermined range through printing with an ink as prepared by kneading a light-emitting material of copper-doped zinc sulfide (Cu—ZnS) and a binder of a fluorine resin. The dielectric layer 6 is formed through printing with an ink as prepared by kneading a ferroelectric substance of barium titanate (BaTiO3) and a binder. The back electrode layer 7 is formed through printing with an ink as prepared by kneading a carbon powder and a binder.

The circuit board 1 is of an insulating plate, on the front surface of which is formed a circuit pattern (not shown). On the back surface of the circuit pattern, mounted is a circuit device (not shown) that is electrically connected with the circuit pattern to constitute a driving circuit. On the front surface of the circuit board 1, provided are a pair of connecting patterns (not shown) that are electrically connected with the driving circuit. The pair of connecting patterns are so positioned that they face each other at the both sides of the circuit board 1. Those connecting patterns are bonded under thermal pressure to the connecting electrodes 3*a*, 3*b* of the EL device 2 via conductive adhesives 8*a*, 8*b*, respectively, and are electrically connected with them.

Regarding the structure of connecting the circuit board 1 and the electroluminescent element 2, a flexible, insulating resin layer 10*a* is formed on the back surface of the transparent electrode layer 4*a* for one connecting pattern in the left side of FIG. 1, as in FIG. 2A. The insulating resin layer 10*a* is formed through printing with a liquid polyester or polyvinyl resin, and this is well bondable to the transparent electrode layer 4*a*. On the back surface of the insulating resin layer 10*a*, formed is a conductive layer 11, for which is used the same ink as that for the back electrode layer 7. In that manner, the transparent electrode layer 4*a* is electrically connected with the conductive layer 11 in the region not having the printed, insulating resin layer 10*a*. One connecting pattern on the circuit board 1 is electrically connected with the transparent electrode layer 4*a* via the conductive layer 11 and the conductive adhesive 8*a*. At the same time, the circuit board 1 and the EL device 2 are bonded to each other via the conductive adhesive 8*a* therebetween.

The constitution of the connecting electrode part 3*b* in the right side of FIG. 1 is shown in FIG. 2B. As illustrated, a flexible, insulating resin layer 10*b* is formed in the position corresponding to the other connecting pattern of the circuit board 1. The insulating resin layer 10*b* separates the light-emitting layer 5 and the dielectric layer 6 as formed on the back surface of the transparent electrode layer 4*a*, into two light-emitting parts. On the back surface of the insulating resin layer 10*b* and the dielectric layer 6, formed is a back electrode layer 7. In that manner, the flexible, insulating resin layers 10*a*, 10*b* are separately formed in predetermined two areas on the transparent electrode layer 4*a*.

The back surface of the back electrode layer 7 in the connecting electrode part 3*b* is bonded to the front surface of the circuit board 1 via a conductive adhesive 8*b* existing therebetween, while the back electrode layer 7 is electrically connected with the other connecting pattern. The insulating resin layer 10*b* formed herein is the same as the insulating resin layer 10*a*noted above.

In the step of bonding the electroluminescent element 2 to the circuit board 1, the connecting electrode parts 3*a*, 3*b* of the electroluminescent element are placed to be on the connecting patterns as formed on the circuit board 1, and a protruding, thermal pressing tool that acts as a hot iron is pressed against the transparent electrode film 4 as formed on the front surface of the both connecting electrodes 3*a*, 3*b*, at a temperature not lower than 160 C, whereby the conductive adhesives 8*a*, 8*b* are melted. After this, the hot pressing tool is released from the transparent electrode film 4. As a result, the temperature of the heated area is lowered, and the conductive adhesives 8*a*, 8*b* are solidified, via which the electroluminescent element 2 is bonded to the circuit board 1. In this step of thermally pressing the transparent electrode film 4 with such a thermal pressing tool, the underlying transparent electrode layer 4*a* of ITO is neither cracked nor peeled off owing to the insulating resin layers 10*a*, 10*b* that act to absorb the thermal pressure shock.

In the illustrated embodiment, the electroluminescent element is bonded to the circuit board to construct the electroluminescent module, which, however, is not limitative. The electroluminescent element may be bonded to a flexible print cable (FPC), a metal lead or any other bonding means, but not to the circuit board, to construct the electroluminescent module of the invention.

As described in detail hereinabove, in the electroluminescent module of the invention, the connecting electrode parts are provided in the position corresponding to the facing opposite sides of the electroluminescent element, and they are electrically connected with each other through thermal pressure bonding. In this, therefore, the bonding space could be reduced.

In addition, on the back surface of the transparent electrode layer in each connecting electrode part, formed is a flexible, insulating resin layer that acts to prevent the delamination of the transparent electrode layer. With that constitution, the operation trouble in the electroluminescent module of the invention is prevented, and the life of the electroluminescent module is prolonged. Moreover, in the electroluminescent module of the invention, the circuit board and the electroluminescent element are electrically connected with each other while being physically bonded to each other. Therefore, the process for producing the electroluminescent module is simplified, and the production costs for it are reduced.

While the invention has been described in detail and with reference to specific embodiments thereof, it will be apparent to one skilled in the art that various changes and modifications can be made therein without departing from the spirit and scope thereof.

What is claimed is:

1. An electroluminescent module comprising an electroluminescent element and a bonding structure, wherein the electroluminescent element has a light-emitting layer, a dielectric layer and a back electrode layer as laminated in that order on a transparent electrode layer formed on a transparent electrode film; said electroluminescent element or a driving circuit connected with said electroluminescent element is mounted on said bonding structure; and wherein said bonding structure is so positioned that at least a part of it overlaps with said electroluminescent element, the electroluminescent element comprising:

a first connecting electrode part formed in said transparent electrode layer and a second connecting electrode part formed in said back electrode layer; the first and second connecting electrode parts separately and electrically connected with a pair of connecting patterns for said electroluminescent element as provided on said bonding structure; and said first and second connecting electrode parts provided in the facing opposite sides of said electroluminescent element.

2. The electroluminescent module according to claim 1, wherein said bonding structure is a circuit board.

3. The electroluminescent module according to claim 1, wherein said bonding structure is a flexible print cable.

4. The electroluminescent module according to claim 1, wherein said bonding structure is a metal lead.

5. The electroluminescent module according to claim 1, wherein said electroluminescent element further comprises:

a flexible, insulating resin layer provided on said transparent electrode layer at two predetermined separate sites, a first connecting electrode part that is electrically connected with said transparent electrode layer at one site of said insulating resin layer, a second connecting electrode part that is electrically connected with said back electrode layer at the other site of said insulating resin layer, and said first and second connecting electrode parts electrically connected with a pair of connecting patterns on said bonding structure through thermal pressing bonding.

6. An electroluminescent module comprising an electroluminescent element and a bonding structure, wherein the electroluminescent element has a light-emitting layer, a dielectric layer and a back electrode layer as laminated in that order on a transparent electrode layer formed on a transparent electrode film; said electroluminescent element or a driving circuit connected with said electroluminescent element is mounted on said bonding structure; and wherein said bonding structure is so positioned that at least a part of it overlaps with said electroluminescent element, the electroluminescent element comprising:

a flexible, insulating resin layer provided on said transparent electrode layer at two predetermined separate sites, a first connecting electrode part that is electrically connected with said transparent electrode layer at one site of said insulating resin layer, a second connecting electrode part that is electrically connected with said back electrode layer at the other site of said insulating resin layer, and said first and second connecting electrode parts electrically connected with a pair of connecting patterns on said bonding structure through thermal pressing bonding.

7. The electroluminescent module according to claim 2, wherein said bonding structure is a circuit board.

8. The electroluminescent module according to claim 2, wherein said bonding structure is a flexible print cable.

9. The elecroluminescent module according to claim 2, wherein said bonding structure is a metal lead.

* * * * *